US005559405A

United States Patent [19]

[0081]otohamiprodjo

[11] Patent Number: 5,559,405

[45] Date of Patent: Sep. 24, 1996

[54] PARALLEL RESONANT BALLAST WITH BOOST

[75] Inventor: Hubie [0081]otohamiprodjo, Vernon Hills, Ill.

[73] Assignee: Motorola, Inc., Schaumburg, Ill.

[21] Appl. No.: 528,514

[22] Filed: Sep. 14, 1995

Related U.S. Application Data

[63] Continuation of Ser. No. 102,668, Aug. 5, 1993, abandoned.

[51] Int. Cl.[6] ..... H01P 1/20

[52] U.S. Cl. ..... 315/209 R; 315/219; 315/224; 315/DIG. 7; 315/205

[58] Field of Search ..... 315/205, 219, 315/209 R, 224, 307, DIG. 7, DIG. 5, 246, 247

[56] References Cited

U.S. PATENT DOCUMENTS

| | | | |
|---|---|---|---|
| 4,388,562 | 6/1983 | Josephson | 315/DIG. 7 |
| 4,954,754 | 9/1990 | Nilssen | 315/307 |
| 4,972,124 | 11/1990 | Powers | 315/219 |
| 5,023,519 | 6/1991 | Jensen | 315/219 |
| 5,130,610 | 7/1992 | Kakitani | 313/219 |
| 5,191,263 | 3/1993 | Konopka | 315/219 |
| 5,214,355 | 5/1983 | Nilssen | 315/219 |
| 5,399,944 | 3/1995 | Konopka et al. | 315/219 |
| 5,434,477 | 7/1995 | Crouse et al. | 315/247 |
| 5,461,287 | 10/1995 | Russell et al. | 315/247 |
| 5,495,404 | 2/1996 | Stephens | 363/132 |

*Primary Examiner*—Robert Pascal
*Assistant Examiner*—Darius Gambino
*Attorney, Agent, or Firm*—Gary J. Cunningham

[57] ABSTRACT

A ballast for operating gas discharge lamps has a voltage boost, a half-bridge inverter and a parallel resonant circuit. An inverter control inhibits operation of the inverter when power is initially applied to the ballast.

7 Claims, 1 Drawing Sheet

PARALLEL RESONANT BALLAST WITH BOOST

This is a continuation of application Ser. No. 08/102.668, filed Aug. 5, 1993 and now abandoned.

BACKGROUND OF THE INVENTION

Electronic ballasts for powering a gas discharge lamp must provide a high power factor, low total harmonic distortion, and a high efficiency. Simultaneously, the ballasts must be economical to manufacture. Additionally, the ballast must start the lamp quickly.

Electronic ballasts convert AC (alternating current) power at a relatively low frequency (approximately 60 Hz) to AC power at a relatively high frequency. In order to attain good lamp life, the AC power supplied to the gas discharge lamp should be sinusoidal.

A resonant circuit is used to attain the sinusoidal power for the lamps. Two types of resonant circuits are the series resonant circuit and the parallel resonant circuit. A series resonant circuit has an inductor in series with a capacitor. A parallel resonant circuit has an inductor in parallel with a capacitor. The inductance of the inductor and the capacitance of the capacitor are selected so that the resonant circuit resonates at a select, high frequency, usually on the order of 30 KHz (kilohertz).

Ballasts with parallel resonant circuits are generally less expensive to build than ballasts with series resonant circuits. However, parallel resonant circuits are less efficient than the series resonant circuits, due to high losses if the voltage across the parallel resonant circuit is low.

Therefore, a ballast using a parallel resonant circuit which attains a high power factor and low total harmonic distortion is desirable.

DESCRIPTION OF THE CIRCUIT DIAGRAM

Figure 1:
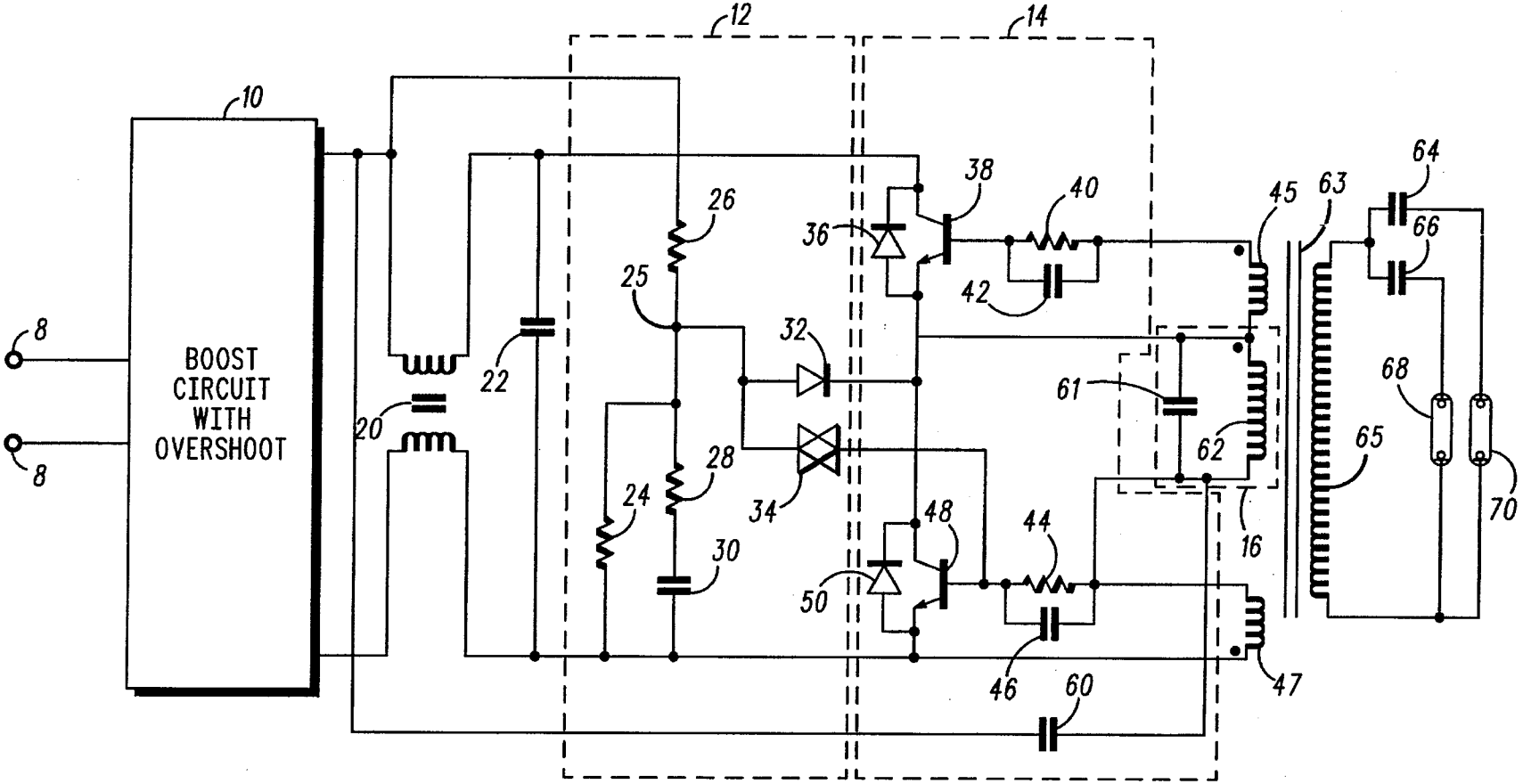
FIG. 1 is a schematic diagram for a ballast using a parallel resonant circuit.

FIG. 1 shows a ballast for powering a pair of gas discharge lamps from a source of AC power (not shown) coupled to the ballast at terminals 8.

Referring generally to FIG. 1, boost circuit 10 has its input connected to terminals 8, and thus to a source of AC power. Terminals 8 are disconnectably coupled to the AC power source, in most cases by a switch. The output of boost circuit 10 provides high DC voltage power to the input of inverter 14. Inverter control 12 inhibits operation of inverter 14 until boost circuit 10 produces a sufficiently high voltage to strike the lamps. Inverter 14, in conjunction with current feed inductor 20, supplies high frequency AC power to parallel resonant tank circuit 16. Parallel resonant tank circuit 16 converts the high frequency AC power into sinusoidal AC power, and powers gas discharge lamps 68, 70.

Referring to FIG. 1 in more detail, terminals 8 connect an AC power source to the circuit. Boost circuit 10 (with overshoot) has its inputs coupled to terminals 8. A high voltage is required at startup in order to strike the lamps. Therefore, boost circuit 10 provides an "overshoot", i.e., the output of boost circuit 10 is very high at startup to assist in striking the lamps. After startup, boost circuit 10 provides at its output a voltage higher than the peak of the AC voltage provided at terminals 8. A boost circuit with overshoot is explained in more detail in a patent issued to Konopka, U.S. Pat. No. 5,191,263, which is incorporated herein by reference.

However, operation of boost circuit 10 is not instantaneous. After terminals 8 are connected to an AC power source, there is a short period of time before the output of boost circuit 10 is sufficient to strike the lamps. During that period of time, operation of inverter 14 is inhibited.

Boost circuit 10 is coupled to current feed inductor 20. Since a parallel-resonant circuit 63 is used, a current source is required for proper operation. Such a current source is provided by current feed inductor 20.

Capacitor 22, coupled in parallel with the current feed inductor 20, eliminates "ringing" due to leakage of the current feed inductor. "Ringing" is subharmonic oscillations of the current feed inductor that could disrupt other components of the ballast.

Resistors 24, 26 form a voltage divider network, with node 25 as the output of the voltage divider network. Diac 34 couples node 25 with inverter 14. At start-up, the voltage at node 25 is insufficient to cause diac 34 to conduct.

When the voltage output of boost circuit 10 is sufficiently high, diac 34 breaks down. By changing the values of resistors 24, 26, the voltage at node 25 can be adjusted to facilitate breaking down of diac 34.

When diac 34 breaks down, resistor 28, coupled between diac 34 and the lower rail of the ballast, limits the current through the diac. Capacitor 30, coupled to node 25 through resistor 28, is charged during the time period before inverter 14 begins to operate. After diac 34 breaks down, energy stored in capacitor 30 is released through resistor 28 and diac 34 into inverter 14. The energy stored in capacitor 30 starts inverter 14.

Diode 32, coupled between node 25 and inverter 14, maintains the voltage at node 25 at a nominal level after inverter 14 begins to operate. Diode 32 has its anode coupled to the transistor junction between transistors 38, 48 and its cathode to node 25.

Inverter 14 is a self-oscillating, half-bridge inverter. Transistors 38 and 48 are coupled between the upper rail and the lower rail of the ballast. Transistors 38, 48 are periodically turned on and off at an approximately 50% duty cycle. Transistor 38 is on (i.e., conducting) when transistor 48 is off (i.e., not conducting), and vice versa. Transistors 38, 48 are turned off and on with a frequency equal to the resonant frequency of parallel resonant tank circuit 16.

Transistor 38 is controlled by a tank circuit composed of resistor 40 in parallel with capacitor 42 and winding 45. Transistor 48 is controlled by a tank circuit composed of resistor 44 in parallel with capacitor 46 and winding 47. Winding 47 has opposite polarity of winding 45.

Diodes 36, 50 are connected in parallel across transistors 38, 48, respectively, in order to allow current to flow around the transistors if that transistor is off.

Parallel resonant tank circuit 16 has capacitor 61 in parallel with primary winding 62 of transformer 63. The capacitance of capacitor 61 and the inductance of primary winding 62 are chosen so that the parallel resonant tank circuit oscillates at a frequency of around 30 KHz (kilohertz).

When parallel resonant tank 16 is in resonance, the current produced in secondary winding 65 of transformer 63 creates current in windings 45, 47. The current in winding 45 is 180 degrees out of phase with the current in winding 47. Thus, transistor 38 turns on when transistor 48 turns off, and transistor 48 turns on when transistor 38 turns off.

Secondary winding 65 of transformer 63 is in parallel with lamps 68, 70. Ballasting capacitor 64 is in series with lamp 70, while ballasting capacitor 66 is in series with lamp 68. Ballasting capacitors 64, 66 limit the current through lamps 68, 70.

Many changes may be made in the form and construction of the component parts in the aforesaid description without departing from the invention described herein.

I claim:

1. An electronic ballast for energizing at least one fluorescent lamp from an AC power source operating at a first frequency, the ballast comprising:

terminals disconnectably coupled to the AC power source;

a boost converter having an input and an output, the boost converter input being coupled to the AC power source, the boost converter having a DC output voltage;

an inverter having an input and an output, the inverter input being coupled to the output of the boost converter, the inverter having an AC output voltage at a second frequency, the second frequency being greater than the first frequency;

an inverter control circuit for starting the inverter, the inverter control circuit being operable to delay startup of the inverter until after the boost converter has begun to operate; and a parallel resonant circuit having an input and an output, the input of the parallel resonant circuit being coupled to the inverter output, the output of the parallel resonant circuit being substantially sinusoidal and coupled to at least one fluorescent lamp.

2. The ballast of claim 1, wherein the inverter is a self-oscillating half-bridge inverter.

3. The ballast of claim 1, wherein the boost converter has an overshoot that maximizes the DC output voltage for a predetermined period of time after startup of the boost converter.

4. The ballast of claim 1, wherein the inverter includes at least one transistor, the transistor having a base, an emitter, and a collector, and the inverter control circuit includes an output that provides substantially minimal or no current to the base of the transistor until after the boost converter has begun to operate.

5. The ballast of claim 4, wherein the inverter control circuit includes a voltage divider network and a diac, the voltage divider network comprising a first resistor in series with a parallel arrangement of a second resistor and a series arrangement of a resistor and a capacitor, the diac being coupled between the base of the transistor and a junction of the first resistor and the parallel arrangement.

6. The ballast of claim 5, wherein the diac is operable to break down and allow energy to be transferred from the capacitor to the base of the transistor for a period of time after the boost converter has begun to operate.

7. An electronic ballast for energizing at least one fluorescent lamp from an AC power source operating at a first frequency, the ballast comprising:

terminals disconnectably coupled to the AC power source;

a boost converter having an input and an output, the boost converter being coupled to the AC power source, the boost converter having a DC output voltage and an overshoot that maximizes the DC output voltage for a predetermined period of time after startup of the boost converter;

a self-oscillating half-bridge inverter having an input and an output, the inverter input being coupled to the output of the boost converter, the inverter having an AC output voltage at a second frequency, the second frequency being greater than the first frequency, the inverter including at least one transistor, the transistor having a base, an emitter, and a collector;

an inverter control circuit for starting the inverter, the inverter control circuit being operable to delay startup of the inverter until after the boost converter has begun to operate, the inverter control circuit including a voltage divider network and a diac, the voltage divider network comprising a first resistor in series with a parallel arrangement of a second resistor and a series arrangement of a resistor and a capacitor, the diac being coupled between the base of the transistor and a junction of the first resistor and the parallel arrangement, wherein the diac is operable to break down and allow energy to be transferred from the capacitor to the base of a transistor of the inverter for a period of time after the boost converter has begun to operate; and a parallel resonant circuit having an input and an output, the input of the parallel resonant circuit being coupled to the inverter output, the output of the parallel resonant circuit being substantially sinusoidal and coupled to at least one fluorescent lamp.

* * * * *